US010132035B2

(12) United States Patent
Canali et al.

(10) Patent No.: US 10,132,035 B2
(45) Date of Patent: Nov. 20, 2018

(54) METHOD FOR CONTROLLING THE CONDITIONS OF AT LEAST ONE BAND CIRCULATING IN A PAPER MAKING MACHINE

(71) Applicant: S.A. GIUSEPPE CRISTINI S.p.A., Milan (IT)

(72) Inventors: Luca Canali, Milan (IT); Giovanni Cristini, Bergamo (IT)

(73) Assignee: S.A. GIUSEPPE CRISTINI S.P.A., Milan (IT)

( * ) Notice: Subject to any disclaimer, the term of this patent is extended or adjusted under 35 U.S.C. 154(b) by 0 days.

(21) Appl. No.: 15/106,609

(22) PCT Filed: Dec. 29, 2014

(86) PCT No.: PCT/IB2014/067386

§ 371 (c)(1),
(2) Date: Jun. 20, 2016

(87) PCT Pub. No.: WO2015/097682

PCT Pub. Date: Jul. 2, 2015

(65) Prior Publication Data

US 2017/0002516 A1 Jan. 5, 2017

(30) Foreign Application Priority Data

Dec. 27, 2013 (IT) ..... MI2013A002213

(51) Int. Cl.

| | |
|---|---|
| ***D21G 9/00*** | (2006.01) |
| ***D21F 1/32*** | (2006.01) |
| ***D21F 7/12*** | (2006.01) |

(52) U.S. Cl.
CPC ..... *D21G 9/0036* (2013.01); *D21F 1/32* (2013.01); *D21F 7/12* (2013.01)

(58) Field of Classification Search
CPC .. D21G 9/0036; D21G 9/0009; D21G 9/0027; D21F 1/32; D21F 7/003;
(Continued)

(56) References Cited

U.S. PATENT DOCUMENTS 3,859,163 A * 1/1975 Haythornthwaite ..... D21F 1/32 134/15
6,143,092 A 11/2000 Straub et al.
(Continued)

FOREIGN PATENT DOCUMENTS

CA 2811516 A1 * 3/2012 ..... D21F 1/32
CA 2934479 A1 * 7/2015 ..... D21F 1/32
(Continued)

*Primary Examiner* — Jose A Fortuna
(74) *Attorney, Agent, or Firm* — Leason Ellis LLP

(57) ABSTRACT

An apparatus for controlling the conditions of at least one band circulating in a paper making machine along a circulation direction is provided with at least one first detecting device configured to detect at least one first parameter indicative of the humidity of the band and positionable in a first position between a pressing station and a conditioning station of the paper making machine; at least one second detecting device configured to detect at least one second parameter indicative of the humidity of the band and positionable in a second position downstream of the conditioning station; and at least one processing unit configured to determine at least one datum indicative of the condition of the band on the basis of the first parameter indicative of the humidity and of the second parameter indicative of the humidity.

11 Claims, 4 Drawing Sheets

(58) Field of Classification Search
CPC .. D21F 7/12; G01N 2021/8416; G01N 22/04; Y10S 162/06; Y10S 162/10
See application file for complete search history.

(56) References Cited

U.S. PATENT DOCUMENTS

| | | | | |
|---|---|---|---|---|
| 7,141,141 | B1 * | 11/2006 | Koskinen | D21F 5/04 162/198 |
| 7,938,935 | B2 * | 5/2011 | MacHattie | D21F 7/003 162/198 |
| 8,778,141 | B2 * | 7/2014 | Canali | D21F 1/32 162/198 |
| 2009/0095432 | A1 * | 4/2009 | MacHattie | D21F 7/003 162/198 |
| 2011/0259085 | A1 * | 10/2011 | Cristini | G01N 15/0826 73/38 |
| 2013/0299112 | A1 * | 11/2013 | Canali | D21F 1/32 162/263 |
| 2017/0002516 | A1 * | 1/2017 | Canali | D21F 1/32 |

FOREIGN PATENT DOCUMENTS

| | | | | |
|---|---|---|---|---|
| CN | 101896810 | | 11/2010 | |
| EP | 1 225 270 | | 7/2002 | |
| EP | 1 516 954 | | 3/2005 | |
| WO | WO-2009046542 | A1 * | 4/2009 | D21F 7/003 |
| WO | WO 2010/035112 | | 4/2010 | |
| WO | WO-2015097682 | A1 * | 7/2015 | D21F 1/32 |

* cited by examiner

METHOD FOR CONTROLLING THE CONDITIONS OF AT LEAST ONE BAND CIRCULATING IN A PAPER MAKING MACHINE

CROSS REFERENCE TO RELATED APPLICATIONS

The present application is a U.S. National Phase of International Patent Application PCT/IB2014/067386 filed on Dec. 29, 2014, which claims priority to Italian Application No. MI2013A002213, filed on Dec. 27, 2013, each of which is incorporated by reference as if expressly set forth in their respective entireties herein.

TECHNICAL FIELD

The present invention concerns an apparatus and a method for controlling the conditions of at least one band circulating in a paper making machine and paper making machine comprising said apparatus.

BACKGROUND ART

As is known, the traditional paper making machines are provided with one or more bands (commonly known as felts) circulating along closed annular paths, by means of which the paper being formed is transported and processed.

Each section of the machine has, in general, a specific type of band.

To obtain good quality paper, it is important to assess the conditions of the band in each section, in addition to monitoring the conditions of the material transported on it.

The conditions of the band, in terms of absorption of water, transport of water and permeability to water, affect the quality of the paper sheet, in particular during the pressing phase. It is therefore important to monitor the conditions of the band, in particular during the pressing phases of the paper sheet.

It is known that the conditions of a band operating on a paper making machine are assessed by means of apparatus which simultaneously measures permeability and humidity of the band, as illustrated for example in U.S. Pat. No. 7,506,550. The apparatus described in U.S. Pat. No. 7,506,550 includes permeability and humidity measurement devices, installed directly on the paper making machine, in a predetermined position along the band and connected to a processing and control unit for continuous monitoring of the band. Another apparatus for controlling the conditions of a band is disclosed in WO2010/035112.

Said apparatus, however, detects data that cannot be inter-correlated for the purpose of making a reliable diagnosis of the condition of the circulating band. An inaccurate and unreliable diagnosis of the condition of the band inevitably results in losses for the paper making machine, in terms of both quality and energy saving.

DISCLOSURE OF INVENTION

One object of the present invention is therefore to provide an apparatus for controlling the conditions of at least one band circulating in a paper making machine which is able to make a reliable diagnosis of the condition of the band and which at the same time is simple to produce.

According to these objects, the present invention concerns an apparatus for controlling the conditions of at least one band circulating in a paper making machine.

A further object of the invention is to provide a method for controlling the conditions of at least one band circulating in a paper making machine which is able to make a diagnosis of the condition of at least one band circulating in a simple reliable manner.

According to these objects, the present invention concerns a method for controlling the conditions of at least one band circulating in a paper making machine.

A further object of the invention is to provide a paper making machine which is reliable and which at the same time offers increased efficiency with respect to the machines of known type.

According to said objects, the present invention concerns a paper making machine.

BRIEF DESCRIPTION OF THE DRAWINGS

Further characteristics and advantages of the present invention will appear clear from the following description of a non-limiting implementation example thereof, with reference to the figures of the accompanying drawings, in which.

BEST MODE FOR CARRYING OUT THE INVENTION

Figure 1:
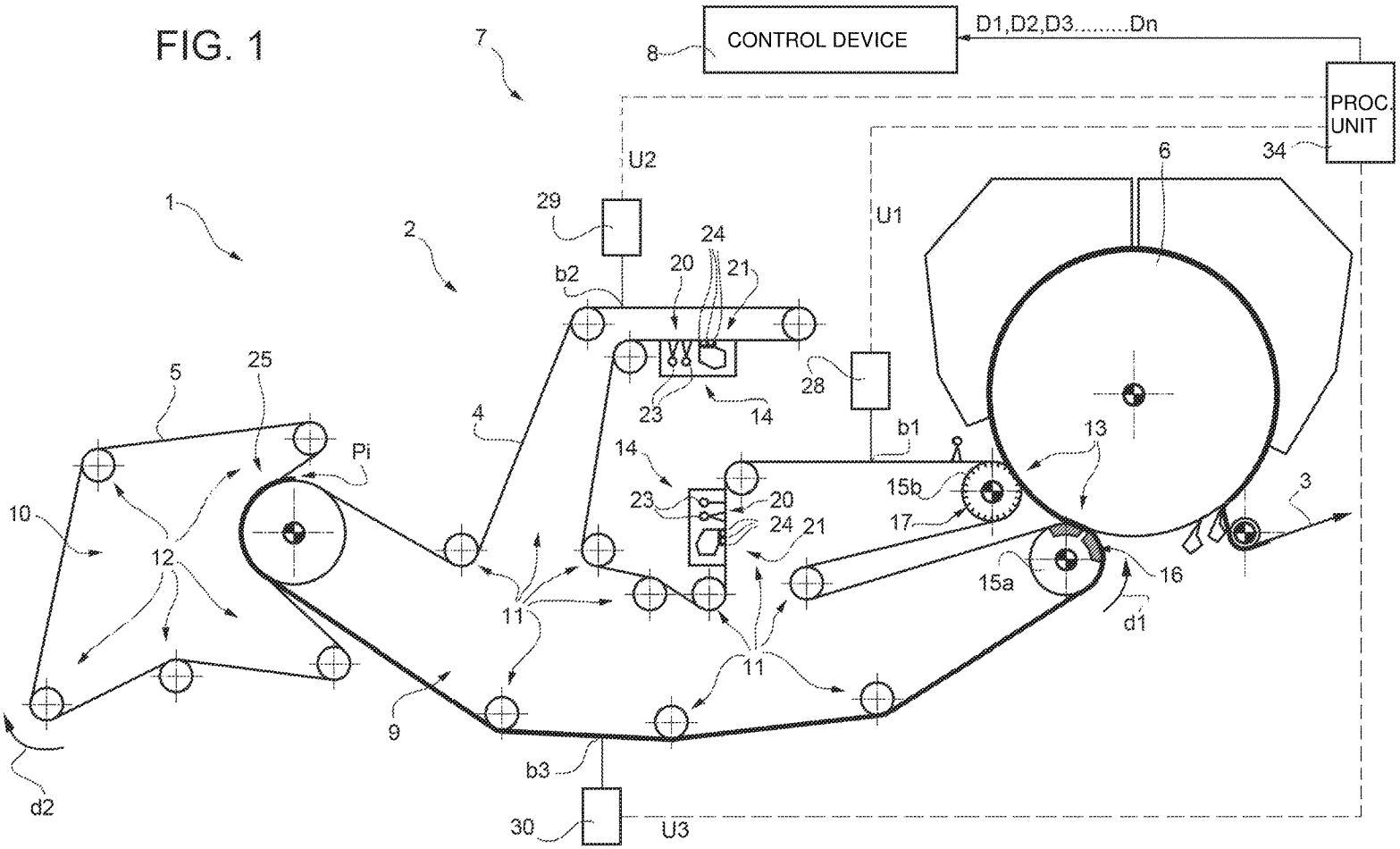
FIG. 1 is a schematic view, with parts removed for clarity, of a portion of a paper making machine according to a first embodiment comprising the apparatus for controlling the conditions of a band according to the present invention.

In FIG. 1 the reference number 1 indicates a paper making machine. In particular, FIG. 1 illustrates exclusively a forming and pressing section 2 of the paper making machine 1 configured to form and press a paper sheet 3.

In the non-limiting example described and illustrated here, the forming and pressing section 2 comprises a first band 4 circulating along a first closed annular path, a second band 5 circulating along a second closed annular path, a static cylinder 6, an apparatus 7 for controlling the conditions of at least one band circulating in the machine 1 according to the present invention and a control device 8.

It is understood that the forming and pressing section 2 of the paper making machine 1 can comprise a variable number of circulating bands greater than or equal to 1 and more than one static cylinder according to the type of machine and the operating configurations scheduled.

In particular, the machine 1 comprises first support means 9 configured to support the first band 4 along the first path and second support means 10 configured to support the second band 5 along the second path.

The first support means 9 are defined by a plurality of first idler rollers 11, which are moved so that the band 4 runs along the path in an anticlockwise direction d1, as indicated by the arrow in FIG. 1.

The second support means 10 are defined by a plurality of idler rollers 12, which are moved so that the band 5 runs along the path in a clockwise direction d2, as indicated by the arrow in FIG. 1.

The machine 1 further comprises at least one pressing station 13 and at least one conditioning station 14.

The pressing station 13 is configured so as to press a paper sheet arranged in contact with at least one band.

In the non-limiting example described and illustrated here, the machine 1 comprises two pressing stations 13 arranged along the first path of the first band 4 and two conditioning stations 14 arranged along the first path of the first band 4.

In the non-limiting example described and illustrated here, the pressing stations 13 are arranged in sequence along the path of the first band 4 and the conditioning stations 14 are arranged in sequence along the path of the first band 4 downstream of the two pressing stations 13.

Each pressing station 13 is defined by at least two rollers opposite each other so as to exert a pressure on the sheet 3 and on the first band 4 and favour expulsion of the water contained in the sheet 3 via the band 4, and if necessary via the rollers.

In each pressing station 13 a certain quantity of water is removed from the sheet 3.

In the non-limiting example described and illustrated here, the pressing stations 13 are defined by respective pressing rollers 15*a* 15*b* and by the static cylinder 6.

The pressing rollers 15*a* 15*b* are rollers of the plurality of idler rollers 11 arranged so as to cooperate substantially abutting against the static cylinder 6 to press the sheet 3 against the first band 4.

In the non-limiting example described and illustrated here, the pressing rollers 15*a* 15*b* have a diameter preferably greater than the diameter of the remaining rollers of the plurality of idler rollers 11.

Preferably, the pressing roller 15*a* is provided with an auxiliary suction device 16, adapted to draw off the excess water, whereas the roller 15*b* is provided with a drainage device 17 defined by a plurality of ribs made on the surface of the roller 15*b* and schematically represented in FIG. 1.

The auxiliary suction device 16 and the drainage device 17 favour elimination of the water from the sheet 3 draining the water released from the band 4 during the pressing.

The static cylinder 6 is preferably provided with heating means (not illustrated in the attached figures) able to dry the sheet 3. In this way the static cylinder 6 has a dual function: pressing and drying of the sheet 3.

Each conditioning station 14 comprises at least one washing device 20, configured to spray water on the band 4, and at least one suction device 21, configured to draw water from the band 4. The suction phase is performed after the washing phase so that the band 4 on which the sheet is laid has a predetermined humidity value.

The band 4, in fact, must have an optimal humidity level to guarantee that, during the pressing phase in the pressing stations 13, the band 4 correctly performs its function of carrying the water coming out of the sheet 3.

In detail, the washing device 20 comprises a plurality of nozzles 23 arranged substantially in contact with the band 4, while the suction device 21 comprises a plurality of suction boxes 24 arranged in sequence in contact with the band 4.

The plurality of nozzles 23 and the suction boxes 24 are regulated by the control device 8, as will be seen in detail below.

In use, a layer of cellulose pulp is laid on the first band 4 at an inlet point Pi upstream of a forming station 25 in which the first band 4 and the second band 5 are substantially arranged facing and in contact with each other so as to give the pulp the form of a sheet 3.

The inlet point Pi is arranged upstream of the pressing stations 13 so that the paper sheet 3 just generated in the forming station is transported by the band 4 along a path which crosses, in sequence, the first and the second pressing section 13.

The paper sheet 3 is then made to adhere to the static cylinder 6 in order to undergo drying and subsequently withdrawn to be fed to the finishing section; the first band 4 is fed to the conditioning stations 14.

The apparatus 7 for controlling the conditions of at least one band circulating in the machine 1 according to the present invention comprises at least one first detecting device 28 configured to detect at least one first parameter U1 indicative of the humidity of the band 4 in a first position b1 along the first path, and at least one second detecting device 29 configured to detect at least one second parameter U2 indicative of the humidity of the band 4 in a second position b2 of the path.

Preferably, the apparatus 7 further comprises a third detecting device 30 configured to detect at least one third parameter U3 indicative of the humidity of the band 4 and of the paper sheet 3 in a third position b3 along the first path.

Lastly, the apparatus 7 comprises a processing unit 34 configured to process the data coming from the first detecting device 28, from the second detecting device 29 and from the third detecting device 30 and to calculate at least one condition of the band 4 on the basis of the incoming data.

The first position b1 is between the pressing stations 13 and the conditioning stations 14 and belongs to an area in which the band 4 does not support the paper sheet 3. The first detecting device 28, therefore, detects the first parameter U1 indicative of the humidity of the band 4 downstream of the pressing stations 13 and upstream of the conditioning sections 14. The first parameter U1 is therefore indicative of the quantity of water contained in the band 4 downstream of the pressing stations 13 and therefore will be affected by the initial conditions of the band 4 upstream of the pressing stations 13 and by the degree of pressing (for example: pressure level, entry and exit angle of the band 4 with respect to the static cylinder 6 and the respective pressing roller 15*a* 15*b*, type of pressing rollers 15*a* 15*b* and static cylinder 6 and hardness of the component materials of the pressing rollers 15*a* 15*b* and static cylinder 6).

The second position b2 is between the conditioning stations 14 and the pressing stations 13 and belongs to an area in which the band 4 does not support the paper sheet 3.

Therefore the second position b2 will be between the conditioning stations 14 and the inlet point Pi into which the paper pulp is fed adapted to define the paper sheet 3.

The second detecting device 29, therefore, detects the second parameter U2 indicative of the humidity of the band 4 after the conditioning stations 14 and before the pressing stations 13. The second parameter U2 is therefore indicative of the quantity of water contained in the band 4 downstream of the conditioning phase and therefore will be influenced by the type of conditioning which it has undergone (pressure of the water coming out of the nozzles 23 and degree of suction of the suction boxes 24) and by the conditions of the band 4, in particular its contamination with external agents such as mineral loads, fibres, chemicals, etc.

The third position b3 belongs to an area in which the paper sheet 3 is lying on the band 4.

In the non-limiting example described and illustrated here, the third detecting device 30 will therefore be arranged along the first path in a position between the inlet point Pi of the paper pulp and the pressing stations 13, this being the only section of the first path in which the band 4 supports the paper sheet 3.

The third detecting device 30 will therefore be configured to detect parameter U3 indicative of the humidity of the band 4 and the paper sheet 3.

The parameter U3 indicative of the humidity of the band 4 and the paper sheet 3 is particularly useful for assessing the quantity of water present in the paper sheet 3, and in particular entering the pressing stations 13, the detecting device 30 being arranged upstream of the pressing stations 13.

The first detecting device 28, the second detecting device 29 and the third detecting device 30 are preferably identical.

In the non-limiting example described and illustrated here, the detecting device 28, the detecting device 29 and the third detecting device 30 respectively comprise at least one sensor (not visible in the attached figures) for detecting the quantity of water present in the band 4 and at least one processing module (not visible in the attached figures) configured to process the datum detected by the sensor so as to obtain a datum indicative of the humidity.

Preferably, the sensor is a radiofrequency sensor provided with an emitter configured to emit a signal which is sent to the band 4 and a receiver to detect a frequency response of the band 4.

Preferably, the sensor is a microwave sensor.

Preferably, the sensor is a microwave sensor of the planar type, where microwave sensor of the planar type means a sensor comprising a cavity resonator circuit coupled with a planar transmission line by means of electromagnetic coupling.

The processing module processes the response received from the receiver and obtains a respective indicative value U1 U2 U3 of the humidity.

The processing unit 34 is configured to process the indicative humidity data U1, U2 and U3 coming from the first detecting device 28, from the second detecting device 29 and from the third detecting device 30 respectively so as to obtain a plurality of data D1 D2 D3 . . . Dn indicative of the condition of the band 4, said data being fed to the control device 8.

Figure 2:
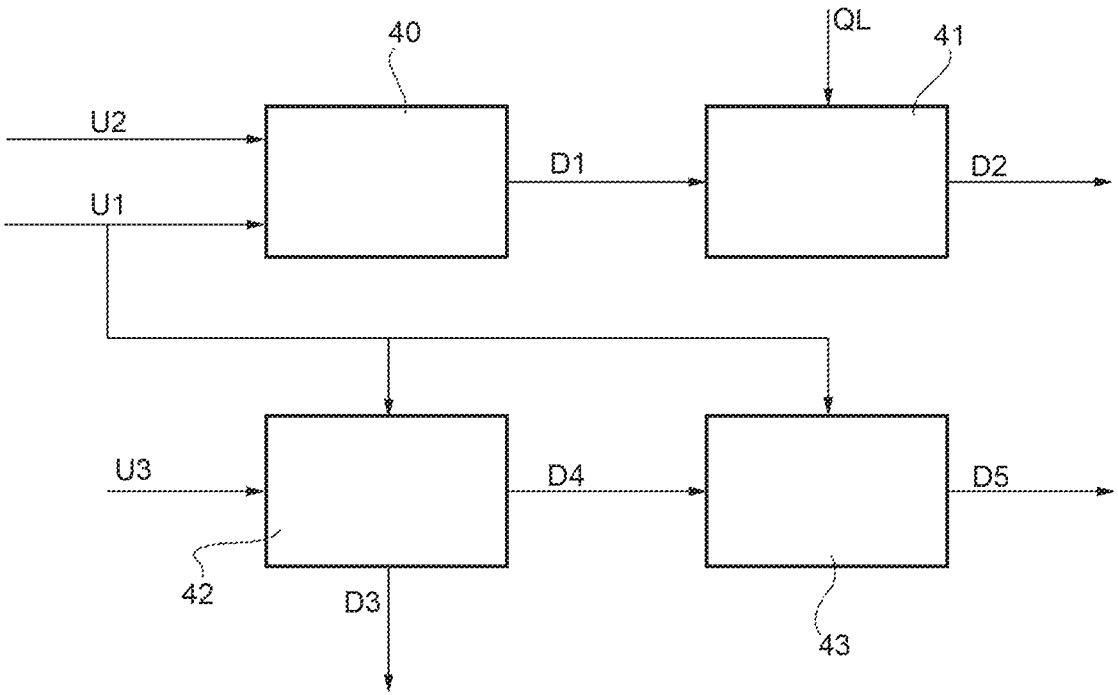
FIG. 2 is a schematic block representation of the apparatus for controlling the conditions of a band of FIG. 1.

With reference to FIG. 2, the processing unit comprises a first calculation module 40 configured to calculate a first datum D1 as the difference between the first parameter U1 indicative of the humidity of the band 4 and the second parameter U2 indicative of the humidity of the band 4.

$$D1=U1-U2$$

The datum D1 represents a humidity value substantially depending on the conditioning phase and on the pressing phase.

The processing unit 34 further comprises a second calculation module 41, configured to calculate a second datum D2 on the basis of the first datum D1 and the quantity of water QL sprayed by the nozzles 23 during the washing (a parameter that can be obtained directly or by means of the control device 8) according to the following formula:

$$D2=D1+QL$$

The second datum D2 defines the quantity of water drawn off by the suction boxes 24.

The processing unit 34 further comprises a third calculation module 42, which is configured to calculate the humidity of the sheet D3.

Considering that the humidity measurement U3 is the sum of the humidity of the sheet D3 and the humidity of the band D4

$$U3=D3+D4$$

Furthermore, the humidity of the band D4 is a function of the humidity value detected in the position b1

$$D4=f(U1)$$

where the function f is obtained for each band from experimental data.

The humidity of the sheet D3 can be easily calculated by means of the following formula $$D3=U3-(f(U1))$$

Lastly, the processing unit 34 comprises a fourth calculation module 43, which is configured to calculate a fifth datum D5 indicative of the quantity of water released from the sheet 3 during the pressing phase. The datum D5 can also assume negative values if the band coming out of the pressing station 13 is drier than the band going into the pressing station.

$$D5=D4-U1=(F(U1))-U1$$

The data D1, D2, D3 . . . Dn processed by the processing unit 34 are then fed to the control device 8 of the machine 1, which regulates the conditioning stations 14 and the pressing stations 13 on the basis of the incoming data.

The expression "regulate the conditioning stations 14" means that the control device 8 is configured to regulate the washing device 20 and/or the suction device 21, whereas the expression "regulate the pressing stations 13" means regulating one or more pressing stations 13.

In particular, the control device 8 is configured to regulate the conditioning stations 14, the pressing stations 13, the elements of the forming section 12, the degree of refinement, the dosage of chemicals in the pulp and the dosages of the chemicals for continuous washing of the bands, so that the second parameter indicative of humidity U2 detected by the second detecting device 29 is as close as possible to an optimal reference value UREF.

The optimal reference value UREF is obtained on the basis of indications relative to the energy consumption of the machine. In particular the UREF value is the humidity value that guarantees minimum energy consumption in terms of motor, vacuum pump and thermal energy consumption (in particular during drying).

In a variation of the present invention, the regulation of the conditioning station 14 is not performed by the control device 8 on the basis of the incoming data D1, D2, D3 . . . Dn processed by the processing unit 34, but by the distributed control system (DCS) of the paper making machine 1 (not illustrated in the attached figures). The regulation of the conditioning station 14 by the distributed control system (DCS) of the paper making machine 1 can be based on the data D1, D2, D3 . . . Dn processed by the processing unit 34 and/or on other significant data.

Figure 3:
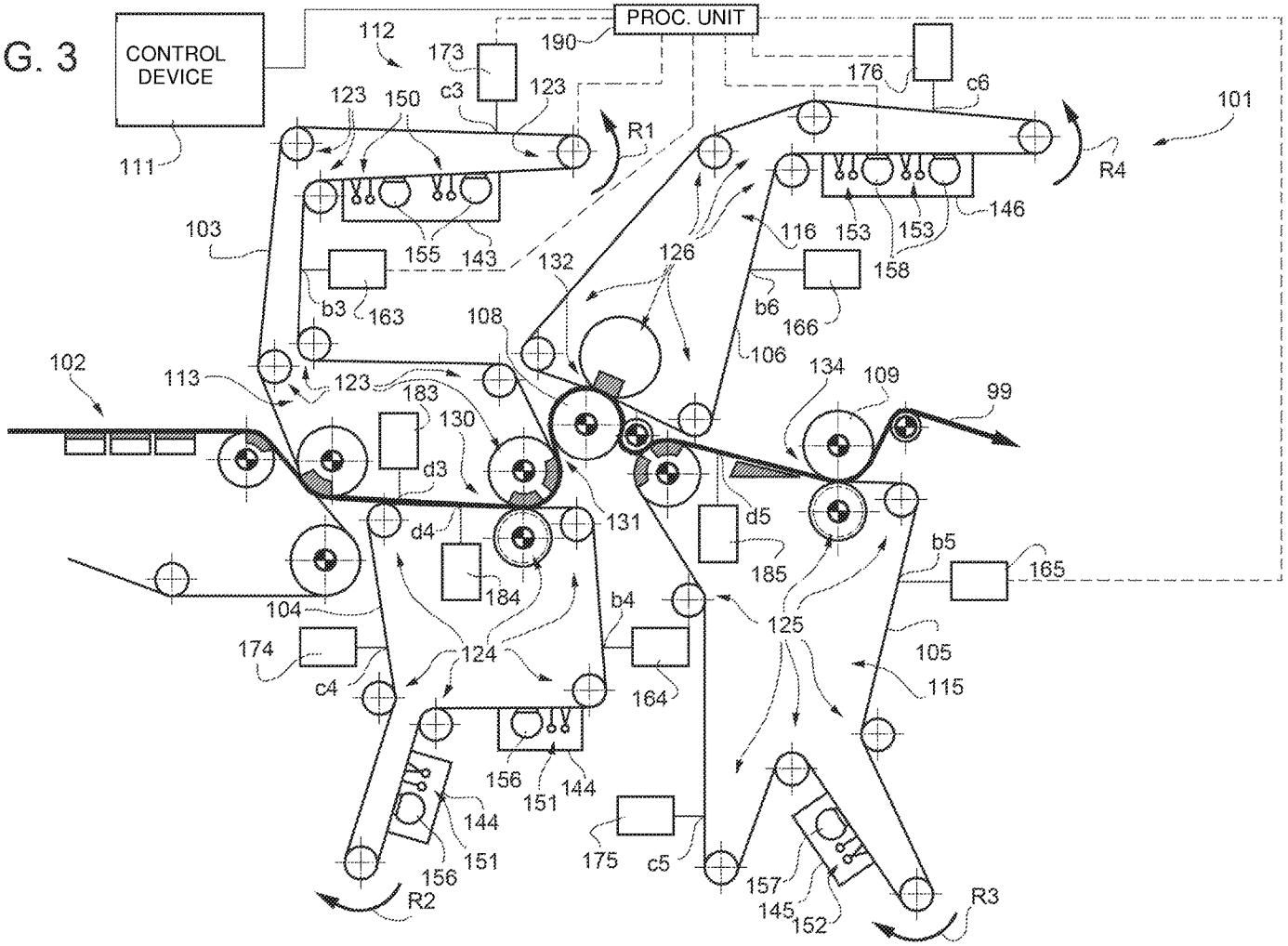
FIG. 3 is a schematic view, with parts removed for clarity, of a portion of a paper making machine according to a second embodiment comprising the apparatus according to the present invention.

FIG. 3 illustrates a portion 101 of a paper making machine 100 according to a second embodiment.

The portion 101 illustrated in FIG. 2 is relative to a pressing section of a paper sheet 99 normally between a forming section 102 (partially illustrated) and a drying section (not illustrated).

Figure 4:
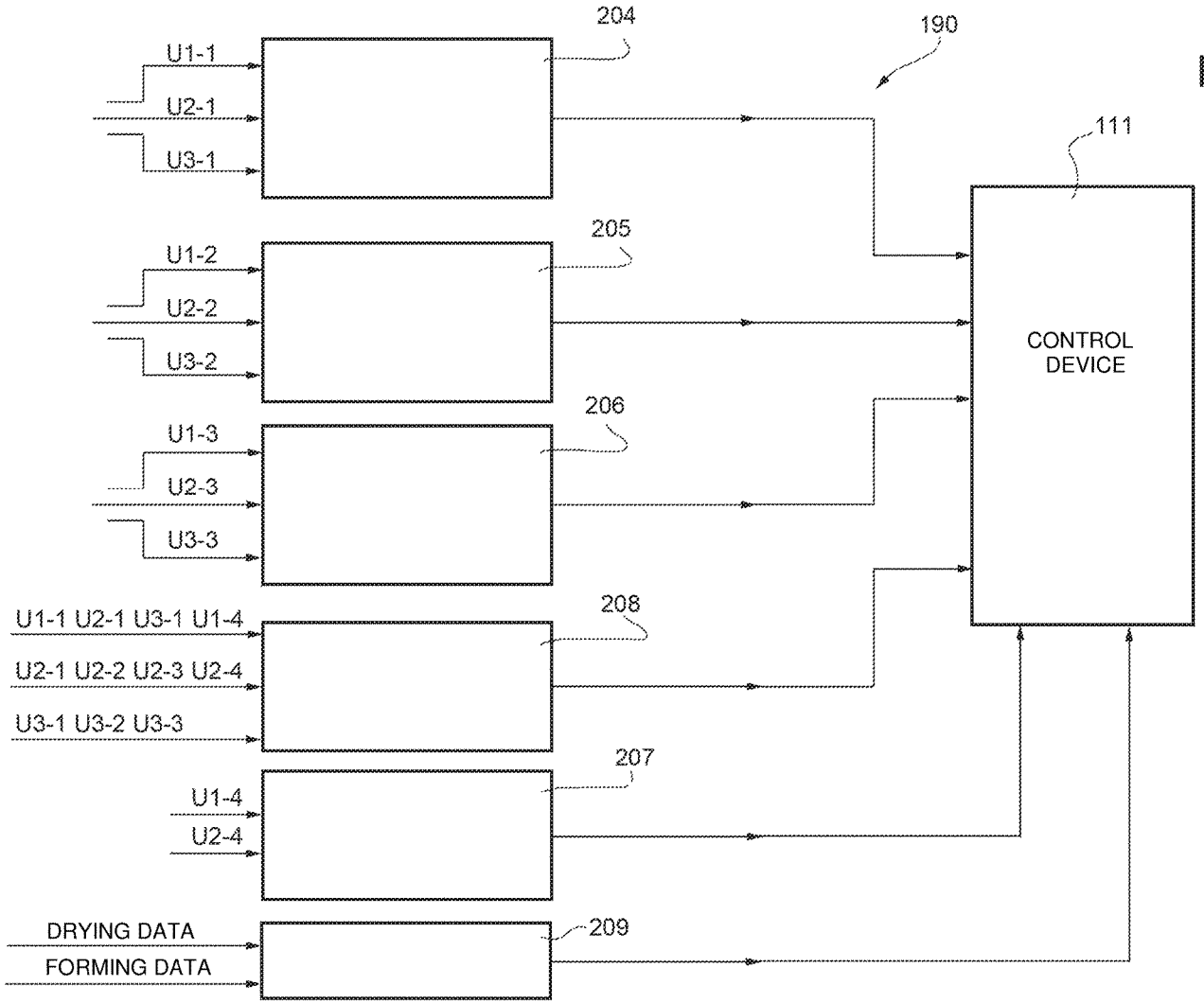
FIG. 4 is a schematic block representation of the apparatus for controlling the conditions of a circulating band of FIG. 2.

The portion 101 of the machine 100 comprises four bands 103 104 105 106 circulating along respective closed annular paths, a first static cylinder 108, a second static cylinder 109, a control device 111 and an apparatus 112 for controlling the conditions of at least one of the bands 103 104 105 106 circulating in the machine 1 according to the present invention (partially illustrated in FIG. 3 and more fully in FIG. 4).

It is understood that the pressing section of the paper making machine 1 can comprise a variable number of circulating bands and more than two static cylinders according to the type of machine and the scheduled operating configurations.

Analogously to what is described for the first embodiment, the machine comprises support means 113 114 115 116 configured to support the four bands 103 104 105 106 respectively along the respective closed annular paths.

The support means 113 114 115 116 are defined by respective pluralities of idler rollers 123 124 125 126.

The idler rollers 123 are moved so that the band 103 runs along the path in an anticlockwise direction R1, as indicated by the arrow in FIG. 3.

The idler rollers 124 are moved so that the band 104 runs along the path in a clockwise direction R2, as indicated by the arrow in FIG. 3.

The idler rollers 125 are moved so that the band 105 runs along the path in a clockwise direction R3, as indicated by the arrow in FIG. 3.

The idler rollers 126 are moved so that the band 106 runs along the path in an anticlockwise direction R4, as indicated by the arrow in FIG. 3.

The machine 1 further comprises a first pressing station 130, defined by a idler roller 123 of the first band 103 and by a idler roller 124 of the second band 104 arranged abutting against each other; a second pressing station 131, defined by the idler roller 123 of the first band 103 and by the first static cylinder 108 arranged abutting against each other; a third pressing station 132, defined by a idler roller 126 of the fourth band 106 and by the first static cylinder 108 arranged abutting against each other; and a fourth pressing station 134 defined by a idler roller 125 of the third band 105 and by the second static cylinder 109 arranged abutting against each other.

The idler rollers 123, 124 and 126 preferably have a diameter greater than the diameter of the remaining idler rollers and are provided with drainage or suction systems to facilitate the release of water by the sheet 99 during the pressing phases.

The first pressing station 130 is of the double band type since the paper sheet 99 is arranged between the first band 103 and the second band 104 and pressed by the idler roller 123 and by the idler roller 124.

The second pressing station 131 is of the single band type and the paper sheet 99 lies on the first band 103 and is pressed between the idler roller 123 and the first static cylinder 108.

The third pressing station 132 is of the single band type and the paper sheet 99 lies on the fourth band 106 and is pressed between the idler roller 126 and the first static cylinder 108.

The fourth pressing station 134 is of the single band type and the paper sheet 99 lies on the third band 105 and is pressed between the idler roller 125 and the second static cylinder 109.

For each band 103 104 105 106 the machine 100 comprises a respective conditioning station 143 144 145 146.

In particular, the conditioning station 143 of the first band 103 is arranged downstream of the first pressing station 130 and of the second pressing station 131.

The conditioning station 144 of the second band 104 is arranged downstream of the second pressing station 130. In particular, the conditioning station 144 has a double stage and comprises two successive conditioning sections.

The conditioning station 145 of the third band 105 is arranged downstream of the fourth pressing station 134.

The conditioning station 146 of the fourth band 106 is arranged downstream of the third pressing station 132.

In this way each band 103 104 105 106 is provided with a respective conditioning station 143 144 145 146 arranged downstream of a respective pressing station 130 131 132 134.

Analogously to what was defined previously for the machine of FIG. 1, each pressing station 130 131 132 134 is defined by at least two rollers positioned opposite each other so as to exert a pressure on the paper sheet 99 in order to favour expulsion of the water contained in the paper sheet 99 via the bands 103 104 103 106 105 respectively involved.

Each conditioning station 143 144 145 146 comprises respectively at least one washing device 150 151 152 153, configured to spray water on the respective band 103 104 105 106, and at least one suction device 155 156 157 158, configured to draw water from the respective band 103 104 105 106. The suction phase is performed after the washing phase. The washing devices 150 151 152 153 and the suction devices 155 156 157 158 are regulated by the control device 111 and are substantially identical to the washing devices 20 and to the suction devices 21 described for the embodiment of FIG. 1 and will not be described again for the sake of simplicity.

In use, the paper sheet 99 coming from the forming section 102 is laid on the first band 103 and transported from the band 103 along a path which crosses, in sequence, the first pressing station 130, the second pressing station 131, the third pressing station 132 and the fourth pressing station 134.

The paper sheet 99 is then made to adhere to the second static cylinder 109 and subsequently withdrawn to be fed to the drying and finishing sections (not illustrated), while the bands 103 104 105 106 are fed to the respective conditioning stations 143 144 145 146.

The apparatus 112 for controlling the conditions of at least one band circulating in the machine 1 according to the present invention comprises, for each band 103 104 105 106, at least one first detecting device 163 164 165 166 configured to detect at least one first parameter U1-1 U1-2 U1-3 U1-4 indicative of the humidity of the respective band 103 104 105 106 in a first position b3 b4 b5 b6 along the respective closed annular path, and at least one second detecting device 173 174 175 176 configured to detect at least one second parameter U2-1 U2-2 U2-3 U2-4 indicative of the humidity of the respective band 103 104 105 106 in a second position c3 c4 c5 c6 along the respective closed annular path.

Preferably, the apparatus 112 further comprises a third detecting device 183 184 185 configured to detect at least one third parameter U3-1 U3-2 U3-3 indicative of the humidity of the respective band 103 104 105 in a second position d3 d4 d5 along the respective closed annular path.

Lastly, the apparatus 112 comprises a processing unit 190 configured to process the data coming from the first detecting devices 163 164 165 166, from the second detecting devices 173 174 175 176 and from the third detecting devices 183 184 185 and to calculate at least one condition of the bands 103 104 105 106 on the basis of the incoming data.

The first position b3 of the band 103 is arranged between the pressing stations 130 and 131 and the conditioning station 143 and belongs to an area in which the band 103 does not support the paper sheet 99. The first detecting device 163, therefore, detects the first parameter U1-1 indicative of the humidity of the band 103 after the pressing and before entry into the conditioning station 143.

The first position b4 of the band 104 is arranged between the pressing station 130 and the conditioning stations 144 and belongs to an area in which the band 104 does not support the paper sheet 99. The first detecting device 164, therefore, detects the first parameter U1-2 indicative of the humidity of the band 104 after the pressing and before entry into the conditioning station 144.

The first position b5 of the band 105 is arranged between the pressing station 134 and the conditioning station 145 and belongs to an area in which the band 105 does not support the paper sheet 99. The first detecting device 165, therefore, detects the first parameter U1-3 indicative of the humidity of the band 105 after pressing and before entry into the conditioning station 145.

The first position b6 of the band 106 is arranged between the pressing station 132 and the conditioning station 146 and belongs to an area in which the band 106 does not support the paper sheet 99. The first detection device 166, therefore, detects the first parameter U1-4 indicative of the humidity of the band 106 after pressing and before entry into the conditioning station 146.

The first parameters U1-1 U1-2 U1-3 U1-4 indicative of the humidity of the respective band 103 104 105 106 in a first position b3 b4 b5 b6 along the respective closed annular path are therefore indicative of the quantity of water contained in the respective bands 103 104 105 106 downstream of the pressing phase and therefore will be influenced by the initial conditions of the bands 103 104 105 106 upstream of the pressing stations and by the degree of pressing (for example: pressure level, entry and exit angle of the band with respect to the static cylinder and the respective pressing roller, type of pressing rollers and static cylinder and hardness of the component materials of the pressing rollers and static cylinder).

The second position c3 of the band 103 is arranged between the conditioning station 143 and the pressing stations 130 and 131 and belongs to an area in which the band 103 does not support the paper sheet 99.

The second detecting device 173, therefore, detects the second parameter U2-1 indicative of the humidity of the band 103 after the conditioning station 143 and the pressing stations 130 and 131.

The second position c4 of the band 104 is arranged between the conditioning stations 144 and the pressing station 130 and belongs to an area in which the band 104 does not support the paper sheet 99.

The second detecting device 174, therefore, detects the first parameter U2-2 indicative of the humidity of the band 104 after the pressing and the conditioning station 144.

The second position c5 of the band 105 is arranged between the conditioning station 145 and the pressing station 134 and belongs to an area in which the band 105 does not support the paper sheet 99. The second detecting device 175, therefore, detects the second parameter U2-3 indicative of the humidity of the band 105 after the pressing and the conditioning station 145.

The second position c6 of the band 106 is arranged between the conditioning station 146 and the pressing station 132 and belongs to an area in which the band 106 does not support the paper sheet 99. The second detecting device 176, therefore, detects the first parameter U2-4 indicative of the humidity of the band 106 after the pressing and the conditioning station 146.

The second parameters U2-1 U2-2 U2-3 U2-4 are therefore indicative of the humidity of the respective band 103 104 105 106 downstream of the conditioning phase and therefore they will be influenced by the type of conditioning which the band has undergone (pressure of the water coming out of the nozzles and degree of suction of the suction boxes) and the conditions of the band and in particular its contamination with external agents such as mineral loads, fibres, chemicals, etc.

The third positions d3 d4 d5 belong to respective areas of the bands 103 104 105 on which the paper sheet 99 lies on the respective band 103 104 105.

In the non-limiting example described and illustrated here, the detecting devices 184 and 183 of the band 103 and of the band 104 will be arranged at the inlet to the pressing station 131.

The detecting device 185 of the band 105 will be arranged at the outlet of the pressing station 132 and at the inlet of the pressing station 134, whereas the band 106 will not be provided with any detecting device for detecting the humidity of the sheet 99 and of the band 106 since there are no portions of the band 106 on which the sheet 99 lies.

The parameters U3-1 U3-2 U3-3 indicative of the humidity of the sheet 99 and the respective band 103 104 105 are particularly useful for assessing the quantity of water present in the paper sheet 99, and in particular at the inlet of the pressing stations 131 and 134 and 132.

The first detecting devices 163 164 165 166, the second detecting devices 173 174 175 176 and the third detecting devices 183 184 185 are preferably identical. Preferably, the first detecting devices 163 164 165 166, the second detecting devices 173 174 175 176 and the third detecting devices 183 184 185 are identical to the first detecting device 28, to the second detecting device 29 and to the third detecting device 30 described for the embodiment of FIGS. 1 and 2 and therefore they will not be described below.

With reference to FIG. 4, the processing unit 190 is configured to process the data coming from the first detecting devices 163 164 165 166, from the second detecting devices 173 174 175 176 and from the third detecting devices 183 184 185 and to determine at least one condition of the bands 103 104 105 106 on the basis of the incoming data.

In particular, the processing unit 190 comprises for each band 103 104 105 106 at least one respective calculation module 204 205 206 207 configured to calculate data E1, E2, E3 . . . En indicative of the conditions of the single bands 103 104 105 106 analogously to what is described for the first embodiment in FIGS. 1 and 2.

The processing unit 190 further comprises a calculation module 208 configured to calculate data indicative of the influence of the humidity of at least one of the bands 103 104 105 106 vis-à-vis the humidity of the nearest band or the band with which it is in contact.

The processing unit 190 further comprises a calculation module 209 configured to calculate data indicative of the condition of the bands 103 104 105 106 on the basis of data indicative of humidity acquired in the forming section 102 (partially illustrated) and the data acquired at the inlet to the drying section, if available.

The plurality of data calculated by the processing unit 190 are fed to the control device 111.

The control device 111 is configured to regulate the conditioning stations 143 144 145 146 and the pressing stations 130 131 132 134 so that the second parameter indicative of the humidity U2-1 U2-2 U2-3 U2-4 of each band 103 104 105 106 is as close as possible to a respective optimal reference value UREF1 UREF2 UREF3 UREF4.

The optimal reference values UREF1 UREF2 UREF3 UREF4 are defined on the basis of indications relative to the energy consumption of the machine. In particular the optimal reference values UREF1 UREF2 UREF3 UREF4 are the humidity values that guarantee the minimum energy consumption in terms of motor and vacuum pump consumption and thermal energy consumption (in particular during drying).

The expression "regulate the conditioning stations 143 144 145 146" means that the control device 8 is configured to regulate the washing device and/or the suction device of at least one of the conditioning stations 143 144 145 146, while the expression "regulate the pressing stations 130 131 132 134" means regulate at least one of the pressing stations 130 131 132 134.

In a variation of the present invention, the regulation of the conditioning stations 143 144 145 146 is not performed by the control device 111 on the basis of the plurality of data calculated by the processing unit 190, but by the distributed control system (DCS) of the paper making machine 100 (not illustrated in the attached figures). The regulation of the conditioning stations 143 144 145 146 by the distributed control system (DCS) of the paper making machine 100 can be based on the plurality of data calculated by the processing unit 190 and/or on other significant data.

Advantageously, due to the apparatus 7 112 according to the present invention, the paper making machine 1 100 is able to produce a paper sheet having the desired quality characteristics, fully exploiting the potential of the machine and minimising losses.

The consumption of the machine 1 100 is in fact minimised due to the fact that the conditioning and pressing phases are regulated so as to obtain the desired humidity of the band analysed. In this way excessive consumption in the washing and suction phases is avoided, minimising energy consumption and speeding up the conditioning phases.

Due to the reduction in the time required to carry out the conditioning operations (washing and suction) it is possible to increase productivity.

Lastly, it is obvious that modifications and variations can be made to the method and the paper making machine described here without departing from the scope of the attached claims.

The invention claimed is:

1. Method for controlling the conditions of at least one band (4; 103, 104, 105, 106) circulating in a paper making machine (1; 100) along a circulating direction (d1; R1, R2, R3, R4); the method comprising the steps of:

detecting at least one first parameter indicative of humidity (U1; U1-1, U1-2, U1-3, U1-4) of the band (4; 103, 104, 105, 106) in a first position (b1; b3, b4, b5, b6) between a pressing station (13; 130, 134, 132) and a conditioning station (14; 143, 144, 145, 146) of the paper making machine (1; 100);

detecting at least one second parameter indicative of humidity (U2; U2-1, U2-2, U2-3, U2-4) of the band (4; 103, 104, 105, 106) in a second position (b2; c3, c4, c5, c6) downstream of the conditioning station (14; 143, 144, 145, 146) of the paper making machine (1; 100);

detecting at least one third parameter indicative of the humidity (U3; U3-1, U3-2, U3-3) of the band (4; 103, 104, 105, 106) and of the paper sheet (3, 99) in a third position upstream of the pressing station (13; 130, 131, 132, 134);

calculating at least one datum (D1, D2, D3 . . . Dn; E1, E2, E3 . . . En) indicative of the conditions of the band (4; 103, 104, 105, 106) on the basis of the first parameter indicative of humidity (U1; U1-1, U1-2, U1-3, U1-4), of the second parameter indicative of humidity (U2; U2-1, U2-2, U2-3, U2-4) and of the third parameter indicative of the humidity (U3; U3-1, U3-2, U3-3) of the band (4; 103, 104, 105, 106) and of the paper sheet (3, 99).

2. Method according to claim 1, comprising the step of regulating the pressing station (13; 130, 131, 132, 134) and/or the conditioning station (14; 143, 144, 145, 146) on the basis of the datum (D1, D2, D3 . . . Dn; E1, E2, E3 . . . En) indicative of the conditions of the band (4; 103, 104, 105, 106) so that the first parameter indicative of humidity (U1; U1-1, U1-2, U1-3, U1-4) of the band (4; 103, 104, 105, 106) in the first position (b1; b3, b4, b5, b6) is approximately equal to a reference value (UREF; UREF1, UREF2, UREF3, UREF4).

3. Method according to claim 1, wherein the step of detecting at least one first parameter indicative of humidity (U1; U1-1, U1-2, U1-3, U1-4) is performed by at least one first detecting device (28; 163, 164, 165, 166); the step of detecting at least one second parameter indicative of humidity (U2; U2-1, U2-2, U2-3, U2-4) is performed by at least one second detecting device (29; 173, 174, 175, 176); and the step of detecting at least one third parameter indicative of the humidity (U3; U3-1, U3-2, U3-3) is performed by at least one third detecting device (30; 183, 184, 185).

4. Method according to claim 3, wherein the first detecting device (28; 163, 164, 165, 166) and the second detecting device (29; 173, 174, 175, 176) are identical.

5. Method according to claim 3, wherein the first detecting device (28; 163, 164, 165, 166) comprises at least one sensor for detecting a quantity of water and at least one processing module configured to process the datum detected by the sensor so as to calculate a datum indicative of the humidity.

6. Method according to claim 5, wherein the at least one sensor is a radiofrequency sensor.

7. Method according to claim 5, wherein the at least one sensor is a microwave sensor.

8. Method according to claim 7, wherein the sensor is a microwave sensor of the planar type.

9. Method according to claim 3, wherein the third detecting device (30; 183, 184, 185) is identical to the first detecting device (28; 163, 164, 165, 166).

10. Method according to claim 1, wherein the first position, the second position, and third position are located along the same band.

11. Method according to claim 1, wherein the first position and the second positions are located between the pressing station and an inlet point of the at least one band at which the paper sheet is introduced onto the at least one band.

* * * * *